United States Patent [19]

Passoni

[11] 4,123,076

[45] Oct. 31, 1978

[54] PAIR OF ROLLERS FOR ROLLER-SKATES

[76] Inventor: Gianfranco Passoni, Rte. de la Veveyse 24,, 1700 Fribourg, Switzerland

[21] Appl. No.: 782,664

[22] Filed: Mar. 30, 1977

[30] Foreign Application Priority Data

May 4, 1976 [CH] Switzerland ..... 04263/76

[51] Int. Cl.[2] ..... A63C 1/00

[52] U.S. Cl. ..... 280/11.27; 301/5.7

[58] Field of Search ..... 280/11.27, 11.2 B; 301/5.7

[56] References Cited

U.S. PATENT DOCUMENTS 1,743,757 1/1930 Chesnutt ..... 301/5.7

2,822,182 2/1958 Merbler ..... 280/11.2 B

*Primary Examiner*—Joseph F. Peters, Jr.
*Assistant Examiner*—Gene A. Church
*Attorney, Agent, or Firm*—William Anthony Drucker

[57] ABSTRACT

A pair of rollers for roller-skates comprising a hollow mandrel equipped with a projection for attachment to a shoe support. Said mandrel is fixed in rotation and has, at each extremity, a ball-bearing carried on a rotary spindle and held axially by resilient washers. The rotary spindle extends, at each end, beyond the extremities of the mandrel and has rollers mounted on it and held axially by washers, ensuring watertightness, and a lateral support ring. The mandrel has a valve halfway between its extremities.

3 Claims, 1 Drawing Figure

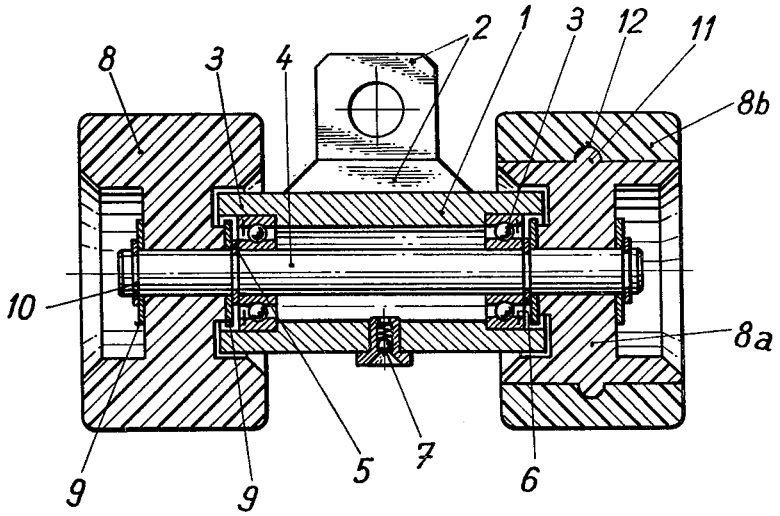
2
1
3
12
11
8
3
4
8b
10
8a
9
9
5
7
6

PAIR OF ROLLERS FOR ROLLER-SKATES

The present invention has as its object a pair of rollers for roller-skates comprising a hollow mandrel equipped with a projection for attachment to a shoe support.

In a known construction, the rollers are mounted on a spindle fixed in a rotation and each roller comprises two ball-bearings. The latter are simply closed by covers which must not touch the roller, so as not to brake it. As a result, there are very large spaces between the center of the roller and the ball-bearings by which dust and dirt can penetrate without hindrance.

The object of the present invention is to eliminate one ball-bearing per roller and to provide a construction in which the ball-bearings are effectively protected. The pair of rollers of the invention is characterized in that the hollow mandrel is fixed in rotation and has, at each extremity, a ball-bearing carried on a rotary spindle and held axially by resilient washers in such a manner that the rotary spindle extends at each end beyond the extremities of the mandrel and has rollers mounted on it secured axially by washers to ensure water-tightness and a lateral support ring, and in that the mandrel has a valve halfway between its extremities.

The single FIGURE of the drawing shows, as an example, one manner of construction of the pair of rollers for roller-skates which is the object of the invention.

The pair of rollers shown comprises a hollow mandrel 1 fixed in rotation and equipped with a projection 2 for attachment to a shoe support. Ball-bearings 3 are positioned at the extremities of the mandrel 1 with the exterior rings fitted in housings provided in the mandrel 1 and with the interior rings carried on a rotary spindle 4. Resilient washers 5 serve the interior rings back in position. On the axially outer side, these ball-bearings 3 are each equipped with a dust cover 6 engaged in the exterior ring of the corresponding ball-bearing and extending radially inwards almost to the interior ring. Halfway between its extremities, the hollow mandrel 1 is equipped with a ball-valve 7 which permits entry of compressed air, to expel dust and dirt which might have been able to penetrate to the interior of the mounting described above.

The rotary spindle 4 extends beyond the two extremities of the mandrel 1. Each extremity of the said spindle has one roller 8 or **8*a*, 8*b* mounted rotatively on it. The sides of the rollers 8 or 8*a*, 8*b* are closed by washers 9 ensuring water-tightness. Finally, a lateral support ring 10 holds the rollers 8 or 8*a*, 8*b* on the rotary spindle 4**.

The rollers may be in one piece, as shown on the left, or in two pieces, as shown on the right in the drawing. In the latter case, the rim **8*a* has a roller band 8*b* held on it by a peripheral ridge 11 on the rim which engages in an annular groove 12 presented by the internal periphery of the roller band 8*b*. By preference, the rollers are of plastic material; however, the roller band 8*b* may be made of a plastic material other than that of the rim 8*a*, for example, a material offering greater elasticity. Axially the rollers 8 or 8*a*, 8*b* may be equipped with a bearing sleeve (not shown) facilitating the rotation of said rollers on the spindle 4. As a variation, the rollers 8 or 8*a*, 8*b* may be mounted in fixed position on the spindle 4**, for example by means of a screw.

As the extremities of the mandrel extend beyond the roller bands of the roller, and, together with the washers 9 and the dust covers 6, they form a labyrinth, the ball-bearings 3 are effectively protected from dust and dirt.

When the rollers 8 or the roller bands **8*b* are worn, only they are changed, without its being necessary to detach the ball-bearings 3**.

I claim:

1. A roller assembly, for roller skates, comprising:

(i) a hollow mandrel having on it a radially projecting member for attachment of the mandrel to a shoe support, said mandrel being recessed internally at each end, (ii) a pair of ball races each including an inner ring and an outer ring, the outer ring of each race being disposed in a respective end recess of the mandrel, (iii) a spindle engaged in and projecting axially at each end beyond the inner rings of the races, said spindle having two axially-spaced circumferential radial recesses in each of its projecting end portions, (iv) a first pair of resilient washers engaged in a first pair of said radial recesses and each abutting the inner ring of a respective ball race, to lock the spindle and the ball races against axial movement relative to the mandrel, (v) a pair of rollers mounted to be freely rotatable each on a respective projecting end portion of the spindle and, (vi) a second pair of resilient washers engaged in the other pair of said radial recesses and each serving to retain a respective one of said rollers on the spindle.

2. A roller assembly, as claimed in claim 1, wherein each roller includes a rim and a replaceable roller band carried on the rim.

3. A roller assembly, as claimed in claim 2 wherein the rim includes at its external periphery a radially projecting ridge which is received in a radial recess in the internal periphery of the roller band.

* * * * *